US010121462B2

(12) United States Patent
Johnston

(10) Patent No.: US 10,121,462 B2
(45) Date of Patent: Nov. 6, 2018

(54) UNIVERSAL TRIGGER MODULE

(71) Applicant: Axis Percussion, Inc., Carson, CA (US)

(72) Inventor: Darrell Nickson Johnston, Harbor City, CA (US)

( * ) Notice: Subject to any disclaimer, the term of this patent is extended or adjusted under 35 U.S.C. 154(b) by 0 days.

(21) Appl. No.: 15/449,237

(22) Filed: Mar. 3, 2017

(65) Prior Publication Data

US 2017/0256247 A1 Sep. 7, 2017

Related U.S. Application Data

(60) Provisional application No. 62/389,594, filed on Mar. 3, 2016.

(51) Int. Cl.
*G10H 3/14* (2006.01)
*G10H 1/34* (2006.01)

(52) U.S. Cl.
CPC ..... *G10H 3/146* (2013.01); *G10H 1/34* (2013.01); *G10H 3/143* (2013.01)

(58) Field of Classification Search
CPC ..... G10H 3/146; G10H 2220/525; G10H 2230/275; G10H 1/0556
See application file for complete search history.

(56) References Cited

U.S. PATENT DOCUMENTS 4,744,279 A * 5/1988 Livingston ..... G10H 1/0556 84/422.1
4,852,443 A * 8/1989 Duncan ..... G10H 1/0551 200/600
2001/0011496 A1* 8/2001 Mishima ..... G10H 3/14 84/600
2012/0048098 A1* 3/2012 Peck ..... G10H 1/32 84/723
2015/0027301 A1* 1/2015 Shih ..... G10H 3/12 84/730
2015/0059559 A1* 3/2015 Takasaki ..... G10H 3/146 84/615

* cited by examiner

*Primary Examiner* — Marlon Fletcher
(74) *Attorney, Agent, or Firm* — Risso I.P.

(57) ABSTRACT

Described is a trigger module that can be used with percussive instruments to generate an electric signal. The trigger module includes an enclosure with a strike plate. A piezoelectric transducer is affixed with the bottom of the strike plate. A striker having a protrusion is attached with the enclosure such that the protrusion rests proximate the strike plate. Thus, forcing the striker towards the strike plate causes the protrusion to impact the strike plate, thereby causing the piezoelectric transducer to generate an electric signal.

6 Claims, 3 Drawing Sheets

UNIVERSAL TRIGGER MODULE

CROSS-REFERENCE TO RELATED APPLICATIONS

The present application is a Non-Provisional Utility Patent Application of U.S. Provisional Application No. 62/389,594, filed on Mar. 3, 2016, entitled, "Universal Trigger Module."

BACKGROUND OF THE INVENTION (1) Field of Invention

The present invention relates to musical instruments and, more particularly, to a trigger module for use in electronic drum and percussion instruments.

(2) Description of Related Art

Musical instruments have been "electric" for many years. For example, electronic drum and percussion instruments have been developed that use digital "sound" files which execute when signaled by a "trigger" device. In an electronic drum set, the actual drums and cymbals are replaced by "triggers" which, when struck, generate a control signal which serves to execute a specific program, ultimately resulting in an audio signal being audibly emitted (i.e., via, an amplifier and loudspeakers). Trigger systems most widely in use today employ piezo-transducers. In addition to acting like a momentary contact switch, these devices produce varying electronic outputs corresponding to the "force" with which they are struck. The term "velocity" refers to this aspect and digital drum controllers use the varying velocity output to change the timber as well as the volume of the sound in an attempt to match the characteristics of real drums. Since percussion instruments range an enormous span of timbres and textures, from a light tap of the finger to being struck full-force, the accurate reproduction of these instruments electronically presents many challenges. Importantly, electronic instruments must perform to the satisfaction of the musician and produce sound to the satisfaction of the listener.

The invention herein described addresses these challenges, resulting in a device of superior accuracy and sensitivity, combined with a unique mounting and adjustment system which allows for ease of operation and installation in ways not previously possible.

SUMMARY OF INVENTION

This disclosure is directed to a trigger module that can be used with percussive instruments to generate an electric signal. The trigger module includes an enclosure with a strike plate. A piezoelectric transducer is affixed with the bottom of the strike plate. A striker having a protrusion is attached with the enclosure such that the protrusion rests proximate the strike plate. Thus, forcing the striker towards the strike plate causes the protrusion to impact the strike plate, thereby causing the piezoelectric transducer to generate an electric signal.

In another aspect, a cushion pad is positioned between the enclosure and striker.

In yet another aspect, a bracket is pivotally attached with the enclosure to allow a user to selectively adjust the angle and position of the striker.

In another aspect, the striker is selected from a group consisting of a leaf spring, torsion spring, extension spring, and compression spring.

In yet another aspect, the striker has a length that extends beyond the enclosure.

Finally, as can be appreciated by one in, the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
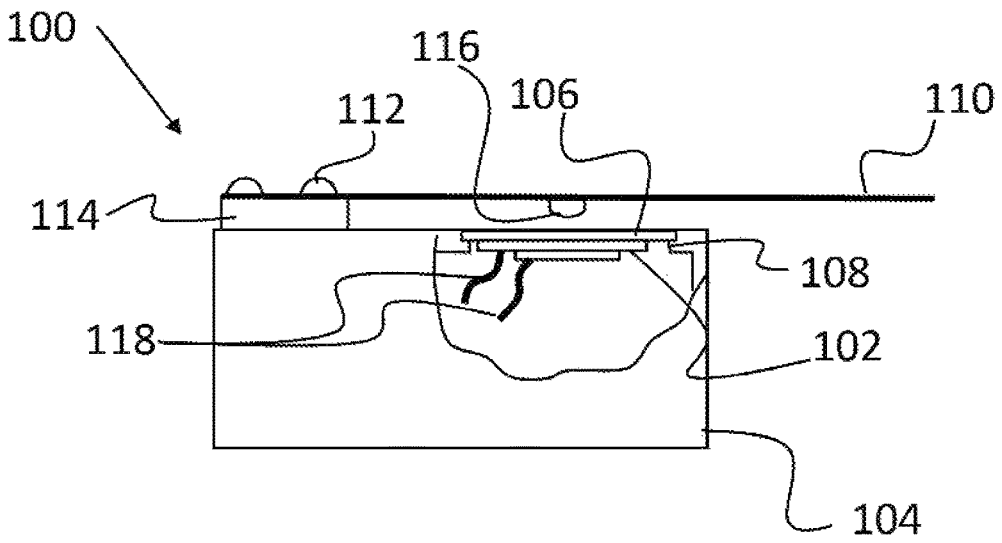
FIG. 1 is a side-view illustration of a trigger module according to various embodiments of the present invention, depicting a partial cutaway view.

The present invention relates to musical instruments and, more particularly, to a trigger module for use in electronic drum and percussion instruments. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

This disclosure is directed, to a trigger module that can be used for the generation of electronic impulses. As a non-limiting example, the trigger module can be used for the production of electronic music, during which the trigger module is capable of rendering an extremely accurate electronic replication of percussive impulses which are applied. The trigger module operates free from the problems which have plagued previous systems (e.g., crosstalk, double triggering, etc.).

As shown in the cut-away side view of FIG. 1, the trigger module 100 includes a transducer 102 that is mounted within or otherwise attached with an enclosure 104 (e.g., formed from aluminum or other suitable material). The enclosure 104 serves to securely hold the transducer 102 (and strike plate 106 as described below) at a desired location. It should be noted that although the interior of the enclosure 104 is desirably fully enclosed, the enclosure 104 is not limited thereto as it may be open or otherwise shaped such that it does not provide for a fully enclosed interior.

The transducer 102 is any mechanism or device that is operable for converting impacts into electronic signals, a non-limiting example of which includes a piezoelectric transducer as commonly known to those skilled in the art. To capture the impact or impulse, the piezoelectric transducer 102 is glued or otherwise adhered to a strike plate 106 (e.g., made of stainless steel or other suitable material). The strike plate 106 is then adhered to the enclosure 104 using any suitable mechanism, technique, or device. As a non-limiting example, the strike plate 106 is press fit into a hole and corresponding lip 108 formed within the enclosure 104.

A striker 110 is attached with the trigger module 100 to provide precise control of the impacts/impulses that hit the strike plate 106. The striker 110 is any suitable mechanism or device that is positioned proximate the strike plate 106 to provide precise impacts to the strike plate 106 and generate signals. As a non-limiting example, the striker 110 is a leaf spring (e.g., metal bar) that is affixed with the enclosure 104 via a pair of screws 112. Other non-limiting examples include the striker 110 being a torsion spring, an extension spring, or a compression spring, or otherwise being, for example, a bar or component that is positioned above and biased away from the strike plate 106 via said springs.

Although not required, an intermediate isolation/cushion pad 114 is desirably positioned between the enclosure 104 and striker 110. The isolation/cushion pad 114 is made of, for example, hard rubber, nylon, or any other material. Desirably, the material of the isolation/cushion pad 114 assists in preventing impulses from traveling through the striker 110 to the enclosure 104. Although depicted as being rectangular shaped, it should be understood that the isolation/cushion pad 114 can be formed in any desired shape, a non-limiting example of which includes being formed in a wedge shape.

On an underside of the striker 110 is a protrusion 116. The protrusion 116 operates as the actual striking point which impacts the strike plate 106. The protrusion 116 can be separately formed and attached with the striker 110 (e.g., a metal or nylon tab glued to the striker 110) or integrally formed as part of the striker 110. As a non-limiting example, the protrusion 116 is formed by punching a top side of the striker 110 to font a dimple (on the top side) which results in a hump (i.e., the protrusion 116) on the bottom side of the striker 110.

The superior performance of the trigger module 100 is due to the unique action provided by the striker 110. Securely anchored to the enclosure 104, its spring flexure delivers super-precision impulses to the transducer (via the protrusion 116), allowing the production of signal pulses (triggers) which "mirror" the occurrence and force (velocity) of the impulse.

Additionally, the spring action of the striker 110 provides protection against damage in the event of incorrect placement or adjustment while in use. In some aspects, the striker 110 may be fabricated with a free length great enough to extend into areas of very forceful impulses, ahead of, and instead of, the more sensitive areas of the enclosure 104 and thereby avoid or eliminate shock-related failures. Thus and as illustrated, the striker 110 can be formed with a length that extends slightly beyond or, in other aspects, well beyond the enclosure 104. As a non-limiting example, the striker 110 extends between one half and one inch beyond the enclosure 104. In other aspects, the striker 110 has a length that is approximately equal to an end of the enclosure 104, or slightly beyond the end of the enclosure 104.

It should also be noted that although the striker 110 is depicted as, being straight, it is not limited thereto as it can be formed with any angle as desired. As a non-limiting example, the striker 110 is angled slightly upwards and away from the enclosure 104.

Also depicted in the cut-away view are the leads 118 of the transducer 102. The leads 118 are used to transfer the electrical signal from the transducer 102 to an electrical connector receptacle, as shown in FIG. 2.

Figure 2:
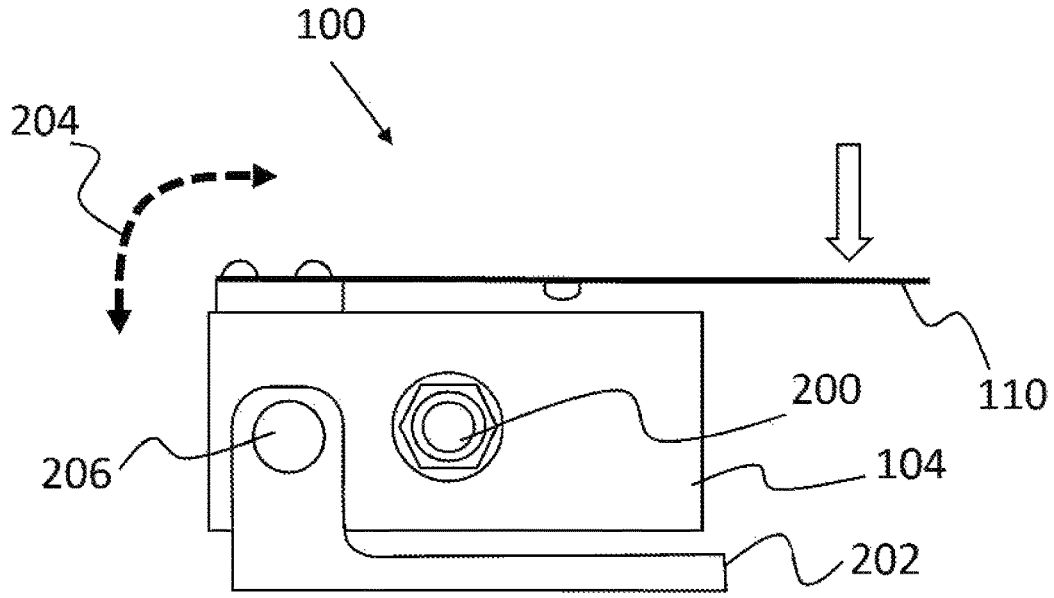
FIG. 2 is a side-view illustration of the trigger module according to various embodiments of the present invention.

FIG. 2 provides a side-view illustration of the trigger module 100. As noted above, an electrical connector receptacle 200 is electrically attached with the leads shown in FIG. 1. The electrical connector receptacle 200 is any suitable mechanism or device that is operable for interfacing with other electrical connectors. As a non-limiting example, the electrical connector receptacle 200 is a one quarter inch RCA phone jack, or XLR, etc.

Figure 5:
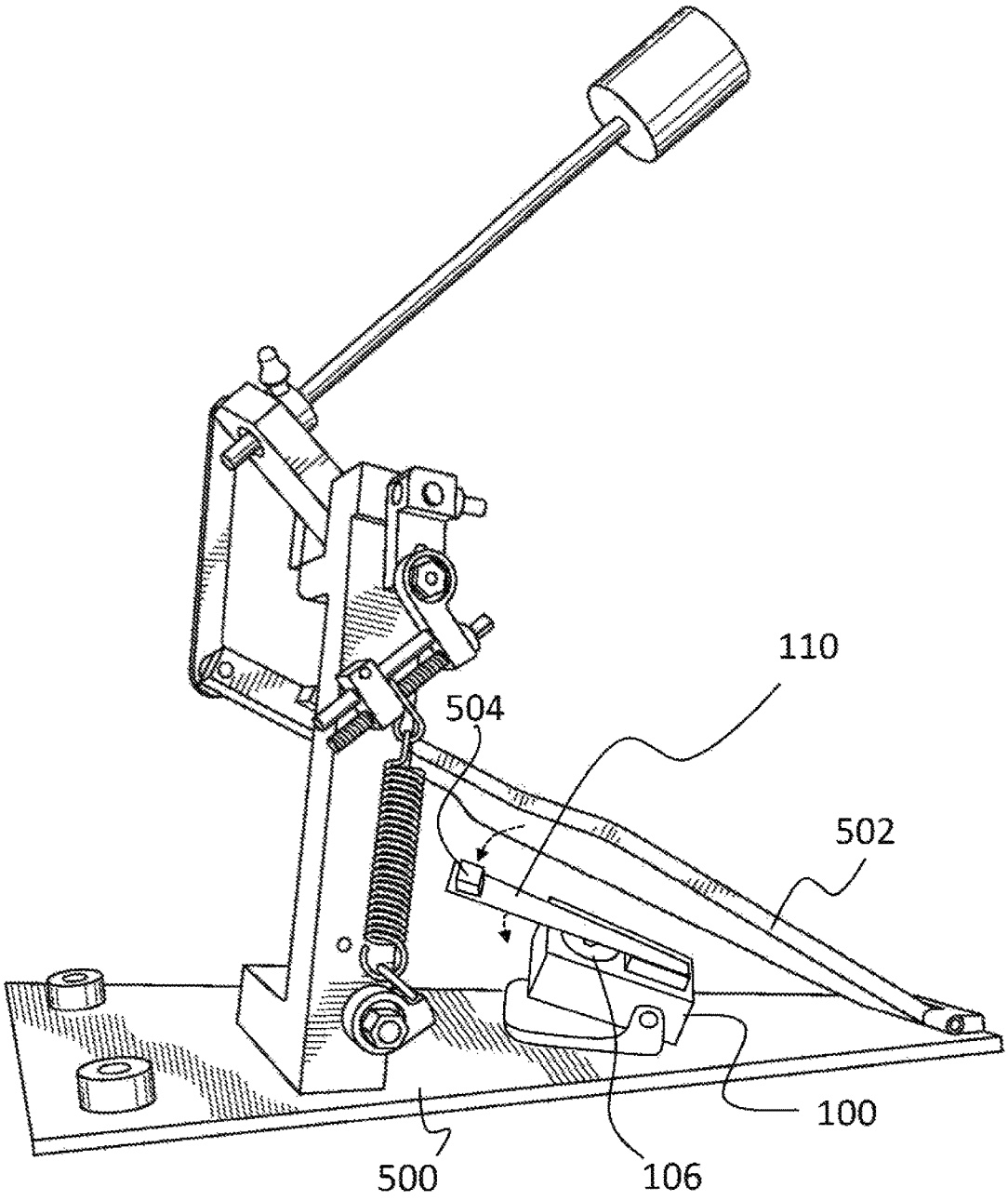
FIG. 5 is a perspective-view illustration depicting the trigger module as attached with a base plate of a drum pedal.

A mounting bracket 202 is desirably included to allow a user to easily attach the trigger module 10 with a desired component. Further, the mounting bracket 202 allows a user to easily alter the angle 204 at which the trigger module 100 and/or striker 110 with respect to the desired instrument (e.g., percussion instrument, as shown in FIG. 5). Operating as a simple "pinch-clamp", the bracket 202 allows for convenient mounting of the trigger module 100 and furthermore, provides the pivot range of motion required for "fine" adjustments during normal operation. To assist a user to easily loosen the bracket 202 to alter the angle 204, a drum key 206 or other suitable device can be used to affix the bracket 202 to the enclosure 104.

Figure 3:
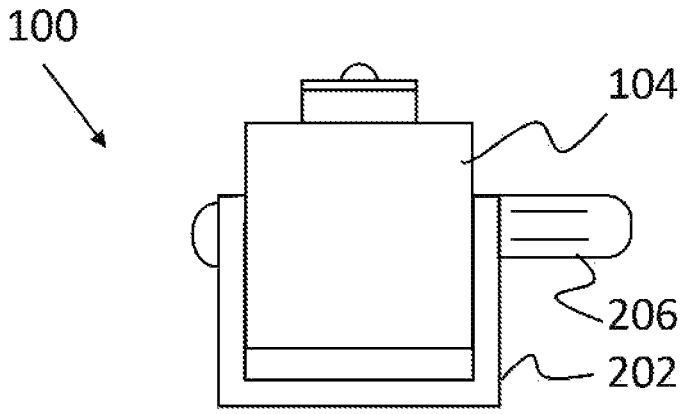
FIG. 3 is a rear-view illustration of the trigger module according to various embodiments of the present invention.
Figure 4:
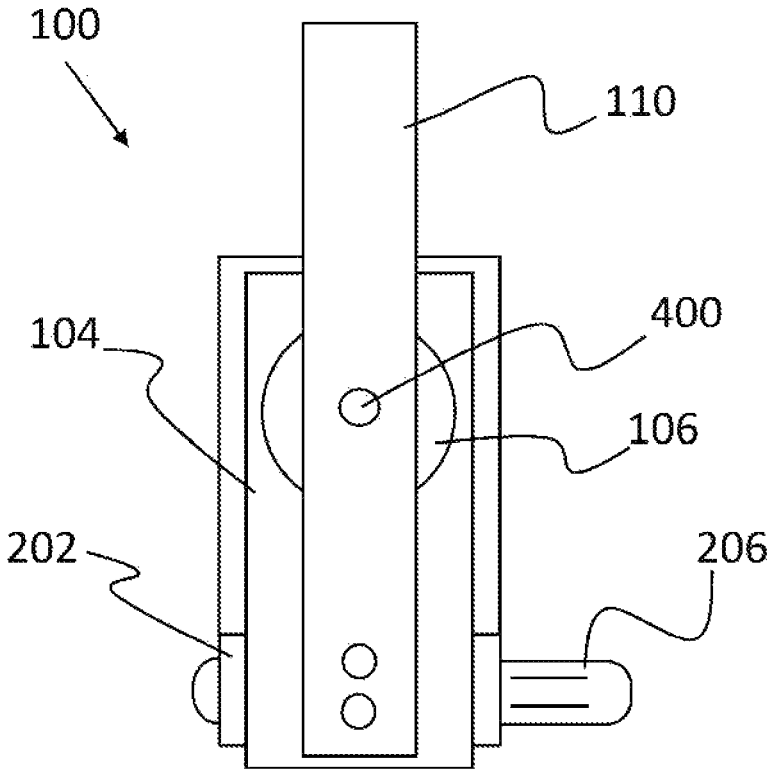
FIG. 4 is a top-view illustration of the trigger module according to various embodiments of the present invention.

FIGS. 3 and 4 provide rear and top-views, respectively, of the trigger module 100. The drum key 206 is shown in the rear-view, which can be used to easily loosen and tighten the bracket 202 against the enclosure 104. FIG. 4 also depicts the strike plate 106 and dimple 400 in the top-side of the striker 110 that is used to form the protrusion on the bottom side of the striker 110.

As noted above and as shown in FIG. 5, the trigger module 100 can be used for the production of electronic music. In this aspect, the trigger module 100 is positioned at the desirable location in which the striker 110 is impacted to transfer the impact/impulse to the transducer within the trigger module 100. As a non-limiting example, the trigger module 100 can be adhered (e.g., screwed, taped, glued, etc.) to the top-side of a drum pedal base plate 500 and below the flip board 502. To further control the forces between the percussive instrument and trigger module 100, a pad 504 (e.g., nylon pad, etc.) can be adhered to a top side of, the striker 110. Thus, in this aspect, depression of the flip board 502 causes the flip board 502 to engage with the pad 504, which forces the striker 110 (and its protrusion) into contact with the strike plate 106, thereby generating the electrical signal is the transducer.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A trigger module, comprising:

an enclosure;

a cushion pad attached to the enclosure;

a strike plate affixed with the enclosure;

a piezoelectric transducer affixed with the strike plate; and a striker having a protrusion, the striker attached to the cushion pad, thereby connecting the striker with the enclosure such that the protrusion rests proximate the strike plate, whereby forcing the striker towards the strike plate causes the protrusion to impact the strike plate, thereby causing the piezoelectric transducer to generate an electric signal.

2. The trigger module as set forth in claim 1, further comprising a bracket pivotally attached with the enclosure.

3. The trigger module as set forth in claim 2, wherein the striker is selected from a group consisting of a leaf spring, torsion spring, extension spring, and compression spring.

4. The trigger module as set forth in claim 3, wherein the striker has a length that extends beyond the enclosure.

5. The trigger module as set forth in claim 1, wherein the striker is selected from a group consisting of a leaf spring, torsion spring, extension spring, and compression spring.

6. The trigger module as set, forth in claim 1, wherein the striker has a length that extends beyond the enclosure.

* * * * *